US008405582B2

(12) United States Patent
Kim

(10) Patent No.: US 8,405,582 B2
(45) Date of Patent: Mar. 26, 2013

(54) ORGANIC LIGHT EMITTING DISPLAY AND DRIVING METHOD THEREOF

(75) Inventor: Yang-Wan Kim, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 870 days.

(21) Appl. No.: 12/419,875

(22) Filed: Apr. 7, 2009

(65) Prior Publication Data

US 2009/0309818 A1 Dec. 17, 2009

Related U.S. Application Data

(60) Provisional application No. 61/060,749, filed on Jun. 11, 2008.

(51) Int. Cl.
*G09G 3/30* (2006.01)
*G09G 3/10* (2006.01)

(52) U.S. Cl. ..... 345/76; 345/77; 315/169.3

(58) Field of Classification Search ..... 345/76–83; 315/169.3; 377/34, 70–73
See application file for complete search history.

(56) References Cited

U.S. PATENT DOCUMENTS

| | | | | |
|---|---|---|---|---|
| 2002/0101172 | A1 | 8/2002 | Bu | |
| 2006/0145965 | A1 | 7/2006 | Choi et al. | |
| 2007/0024542 | A1 * | 2/2007 | Chung et al. | 345/76 |
| 2008/0036708 | A1 | 2/2008 | Shirasaki et al. | |
| 2008/0111812 | A1 * | 5/2008 | Shirasaki et al. | 345/212 |

FOREIGN PATENT DOCUMENTS

| | | | |
|---|---|---|---|
| CN | 1623180 | A | 6/2005 |
| CN | 1977302 | A | 6/2007 |
| EP | 1 231 592 | A2 | 8/2002 |
| JP | 10-254410 | | 9/1998 |
| JP | 2002-278513 | | 9/2002 |
| JP | 2003-058106 | | 2/2003 |
| JP | 2004-004675 | | 1/2004 |
| JP | 2004-045647 | | 2/2004 |
| JP | 2005-99764 | | 4/2005 |
| JP | 2005-115144 | | 4/2005 |
| JP | 2005-157217 | | 6/2005 |
| JP | 2005-227310 | | 8/2005 |
| JP | 2006-284959 | | 10/2006 |
| JP | 2007-047721 | | 2/2007 |

(Continued)

OTHER PUBLICATIONS

European Search Report dated Aug. 12, 2009, for corresponding European Patent application 09162361.1.

(Continued)

*Primary Examiner* — Sumati Lefkowitz
*Assistant Examiner* — Jonathan Horner
(74) *Attorney, Agent, or Firm* — Christie, Parker & Hale, LLP

(57) ABSTRACT

An organic light emitting display includes: scan lines for applying scan signals; control lines for applying control signals; and data lines for applying data signals. The organic light emitting display further includes: pixels coupled to the scan, control and data lines for displaying an image; power supply lines coupled to the pixels; and a data driver for supplying the data signals of the image to the data lines. The organic light emitting display also includes: a power supply driver for swinging a voltage at the power supply lines between a first level and a second level; a sensing unit including a current sink for sinking a first current from the pixels and a current source for supplying a second current to the pixels; and a switching unit for selectively electrically coupling the pixels to at least one of the data driver, the current source or the current sink.

14 Claims, 11 Drawing Sheets

FOREIGN PATENT DOCUMENTS

| | | | |
|---|---|---|---|
| JP | 2007-052202 | | 3/2007 |
| JP | 2007-206139 | | 8/2007 |
| JP | 2007-271840 | | 10/2007 |
| JP | 2007-536585 | | 12/2007 |
| JP | 2008/122848 | | 5/2008 |
| JP | 2009-053382 | | 3/2009 |
| JP | 2009-053647 | | 3/2009 |
| JP | 2009-276673 | | 11/2009 |
| KR | 10-2005-0067800 | | 7/2005 |
| KR | 10-2006-0073685 | A | 6/2006 |
| KR | 10-2006-0112995 | A | 11/2006 |
| KR | 10-2007-0120861 | | 12/2007 |
| KR | 10-2010-0021482 | A | 2/2010 |
| WO | WO 2009/087746 | A1 | 7/2009 |
| WO | WO 2010/001590 | A1 | 1/2010 |

OTHER PUBLICATIONS

Korea Office action dated Sep. 28, 2011, for Korean Patent Application No. 10-2009-0049846, which claims priorities of the corresponding U.S. Appl. No. 61/060,749 and U.S. Appl. No. 12/419,875; 1 page.

Japanese Office action dated Dec. 27, 2011, for corresponding Japanese Patent application 2009-140465, 4 pages.

Japanese Office action dated Jul. 3, 2012, for corresponding Japanese Patent application 2009-140465, (4 pages).

SIPO Patent Gazette dated Jun. 27, 2012, for corresponding Chinese Patent application 200910148835.0, w/English translation of p. 1, (3 pages).

* cited by examiner

120

1211
1212
1213
1214
121m
SSP
SSC
Shift register ...
121
1221
1222
1223
1224
122m
Data2
jbit
Sampling latch unit ...
122
1231
1232
1233
1234
123m
SOE
Holding latch unit ...
123
1241
1242
1243
1244
124m
Signal generator ...
124
1251
1252
1253
1254
125m
Buffer unit ...
125
...
D1
D2
D3
D4
Dm

ORGANIC LIGHT EMITTING DISPLAY AND DRIVING METHOD THEREOF

CROSS-REFERENCE TO RELATED APPLICATION

This application claims priority to and the benefit of U.S. Provisional Patent Application No. 61/060,749 filed Jun. 11, 2008, the entire content of which is incorporated herein by reference.

BACKGROUND

1. Field of the Invention

The present invention relates to an organic light emitting display and a driving method thereof.

2. Discussion of Related Art

Recently, various flat panel display devices having reduced weight and volume in comparison to cathode ray tubes (CRTs) have been developed. Types of flat panel display devices include a liquid crystal display (LCD), a field emission display (FED), a plasma display panel (PDP), and an organic light emitting display, etc.

An organic light emitting display displays an image using organic light emitting diodes that generate light through recombination of electrons and holes. The organic light emitting display has an advantage over other flat panel display devices in that it has a high response speed and is driven with low power consumption.

FIG. 1 is a circuit view showing a pixel of a conventional organic light emitting display.

Referring to FIG. 1, a pixel 4 of a conventional light emitting display includes an organic light emitting diode (OLED) and a pixel circuit 2 coupled to a data line Dm and a scan line Sn to control the organic light emitting diode (OLED).

An anode electrode of the organic light emitting diode (OLED) is coupled to the pixel circuit 2 and a cathode electrode of the OLED is coupled to a second power supply ELVSS. The pixel circuit 2 controls an amount of current supplied to the OLED in accordance with a data signal supplied to the data line Dm when a scan signal is supplied to the scan line Sn. To this end, the pixel circuit 2 includes a second transistor M2 coupled between a first power supply ELVDD and the OLED, a first transistor M1 coupled between the second transistor M2, the data line Dm, and the scan line Sn, and a storage capacitor Cst coupled between a gate electrode and a first electrode of the second transistor M2.

A gate electrode of the first transistor M1 is coupled to the scan line Sn and a first electrode of the first transistor M1 is coupled to the data line Dm. Further, a second electrode of the first transistor M1 is coupled to one terminal of the storage capacitor Cst. Here, the first electrode may be either a source electrode or a drain electrode and the second electrode may be the other one of the source electrode or the drain electrode. For example, if the first electrode is the source electrode, the second electrode is the drain electrode. The first transistor M1 is turned on when the scan signal is applied at its gate to supply the data signal supplied from the data line Dm to the storage capacitor Cst. At this time, the storage capacitor Cst charges a voltage corresponding to the data signal.

The gate electrode of the second transistor M2 is coupled to one side of the storage capacitor Cst and the first electrode of the second transistor M2 is coupled to the other side of the storage capacitor Cst and the first power supply ELVDD. Further, a second electrode of the second transistor M2 is coupled to the anode electrode of the OLED. The second transistor M2 controls the amount of current flowing from the first power supply ELVDD to the second power supply ELVSS via the OLED in accordance with the voltage value stored in the storage capacitor Cst. At this time, the OLED generates light corresponding to the amount of current supplied from the second transistor M2.

The conventional organic light emitting display may not display an image with desired luminance due to the change in efficiency according to the deterioration of the OLED. In practice, the OLED is deteriorated over time so that light with gradually low luminance is generated in response to the same data signal supplied through the data line Dm.

SUMMARY OF THE INVENTION

Therefore, it is an aspect according to an exemplary embodiment of the present invention to provide an organic light emitting display and a driving method thereof capable of compensating for a deterioration of organic light emitting diodes and a non-uniform threshold voltage/mobility among driving transistors in different pixel circuits.

In an exemplary embodiment according to the present invention, an organic light emitting display includes: a plurality of scan lines for applying scan signals; a plurality of control lines for applying control signals; a plurality of data lines for applying data signals, the data lines crossing the scan lines and the control lines; a plurality of pixels for displaying an image, the pixels coupled to the scan lines, the control lines and the data lines; a plurality of power supply lines coupled to the pixels; a data driver for supplying the data signals of the image to the plurality of data lines; a power supply driver for swinging a voltage at the power supply lines between a first level and a second level; a sensing unit including a current sink configured to sink a first current from the pixels and a current source configured to supply a second current to the pixels; and a switching unit for selectively electrically coupling the plurality of pixels to at least one of the data driver, the current source or the current sink.

Each of the pixels may include: a driving transistor and an organic light emitting diode coupled in series between a corresponding one of the power supply lines and a power source, the organic light emitting diode having an anode coupled to the driving transistor and a cathode coupled to the second power source; a data switch between a corresponding one of the data lines and a control electrode of the driving transistor, the data switch having a control electrode coupled to a corresponding one of the scan lines; a capacitor coupled between the first power source and the control electrode of the driving transistor for storing a corresponding one of the data signals; and a control switch between the corresponding one of the data lines and the anode of the organic light emitting diode, the control switch having a control electrode coupled to a corresponding one of the control lines.

The switching unit may include: a first switch between the corresponding one of the data lines and the data driver, the first switch being adapted to turn on when the data driver supplies the corresponding one of the data signals to the corresponding one of the data lines; a second switch between the corresponding one of the data lines and the current source, the second switch being adapted to turn on when the current source supplies the first current to the corresponding one of the data lines; and a third switch between the corresponding one of the data lines and the current sink, the third switch being adapted to turn on when the current sink receives the second current from the corresponding one of the data lines.

The current sink may be adapted to detect a first voltage corresponding to the first current, and the current source may be adapted to detect a second voltage corresponding to the second current.

The organic light emitting display may further include a memory for storing the first voltage and the second voltage.

The organic light emitting display may further include a timing controller adapted to receive external data signals, wherein the timing controller is configured to convert the external data signals to the data signals in accordance with the first voltage and the second voltage.

The first voltage may correspond to threshold voltage/mobility information of the driving transistor. The second voltage may correspond to deterioration information of the organic light emitting diode.

The sensing unit may further include an analog-to-digital converter for converting the first voltage and the second voltage to digital data prior to storing them in the memory.

The voltage applied to the power supply lines while the first current flows may have a level higher than that of a voltage applied to the power supply lines while the second current flows.

In another exemplary embodiment according to the present invention, a method of adjusting luminance of an image displayed on an organic light emitting display is provided. The organic light emitting display includes a plurality of pixels coupled to a plurality of data lines, each of the pixels including a driving transistor and an organic light emitting diode. The method includes: sensing a first voltage while a first current flows through the driving transistor of a pixel among the plurality of pixels to a current sink via a corresponding one of the data lines while a first voltage is being supplied to a corresponding one of the pixels; sensing a second voltage while a second current flows from a current source through the organic light emitting diode of the pixel via the corresponding one of the data lines while a second voltage that is lower than the first voltage is being supplied to the corresponding one of the pixels; and converting external data to a data signal to be applied to the pixel in accordance with the first voltage and the second voltage.

In another exemplary embodiment according to the present invention, an organic light emitting display includes: a plurality of pixels coupled to a plurality of data lines, each of the pixels including a driving transistor and an organic light emitting diode; a current sink for sensing a first voltage corresponding to a first current that flows through the driving transistor of a pixel among the plurality of pixels to the current sink via a corresponding one of the data lines; a current source for sensing a second voltage corresponding to a second current that flows from the current source through the organic light emitting diode of the pixel via the corresponding one of the data lines; a timing controller for adjusting a data signal to be applied to the pixel in accordance with the first voltage and the second voltage; and a power supply line driver for supplying power to the pixels, wherein the power supplied while the first voltage is being sensed has a higher voltage than that of the power supplied while the second voltage is being sensed.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
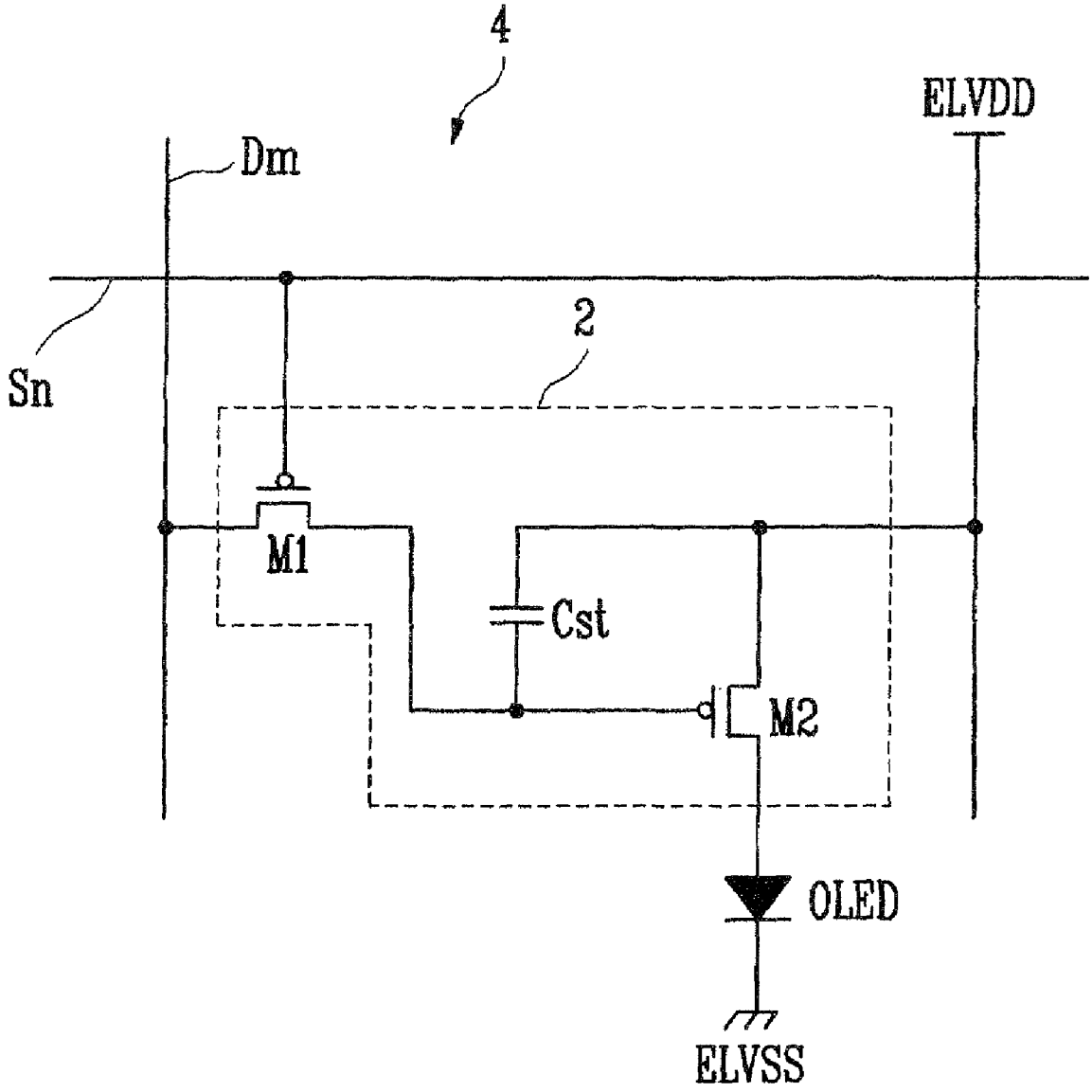
(RELATED ART) FIG. 1
FIG. 1 is a view showing a pixel of a conventional organic light emitting display.

Hereinafter, certain exemplary embodiments according to the present invention will be described with reference to the accompanying drawings. Here, when a first element is described as being coupled to a second element, the first element may be directly coupled to the second element, or may be indirectly coupled to the second element via a third element. Further, some of the elements that are not essential to the complete understanding of the invention are omitted for clarity. Also, like reference numerals refer to like elements throughout.

Hereinafter, embodiments of the present invention will be described in detail with reference to the accompanying drawings.

Figure 2:
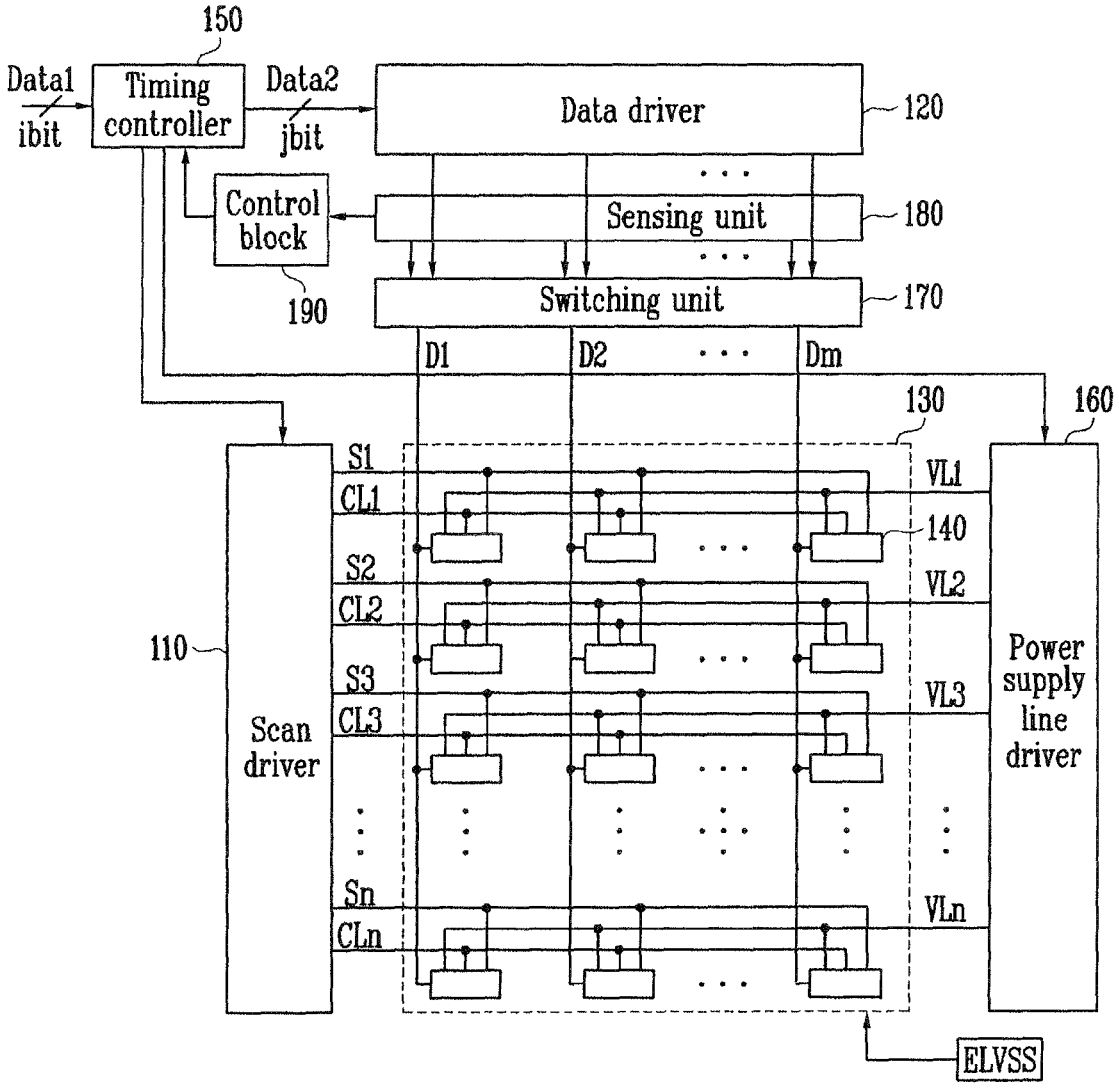
FIG. 2 is a view showing an organic light emitting display according to an exemplary embodiment of the present invention.

FIG. 2 is a view showing an organic light emitting display according to an exemplary embodiment of the present invention.

Referring to FIG. 2, the organic light emitting display according to an exemplary embodiment of the present invention includes a display unit 130 having pixels positioned at crossing regions of scan lines S1 to Sn and data lines D1 to Dm; a scan driver 110 for driving scan lines S1 to Sn and control lines CL1 to CLn; a power supply line driver 160 for driving power supply lines VL1 to VLn; a data driver 120 for driving data lines D1 to Dm; and a timing controller 150 for controlling the scan driver 110, the data driver 120 and the power supply line driver 160.

The organic light emitting display also includes a sensing unit 180 for extracting deterioration information of an organic light emitting diode included in each pixel 140 and threshold voltage/mobility information of a driving transistor; a switching unit 170 for selectively coupling the sensing unit 180 and the data driver 120 to the data lines D1 to Dm; and a control block 190 for storing information sensed by the sensing unit 180.

The display unit 130 includes the pixels 140 positioned at the crossing regions of the scan lines S1 to Sn and the data lines D1 to Dm. The pixels 140 are supplied with first power ELVDD through the power supply lines VL and are supplied with second power ELVSS from the outside. Each of the pixels 140 supplied with the first power ELVDD and the second power ELVSS controls the amount of current supplied from the first power ELVDD to the second power ELVSS via the organic light emitting diode. Then, light with luminance corresponding to the current is generated in the organic light emitting diode.

The scan driver 110 drives the scan lines S1 to Sn and the control lines CL1 to CLn in accordance with the control by the timing controller 150. Also, the data driver 120 supplies data signals to the data lines D1 to Dm in accordance with the control by the timing controller 150. The data signals may have values ranging from +8V to +13V in one embodiment, for example.

The switching unit 170 selectively couples the sensing unit 180 and the data driver 120 to the data lines D1 to Dm. To this end, the switching unit 170 includes at least one switching device coupled (to each of the data lines D1 to Dm. In other words, at least one switching device is provided per channel (or data line) to selectively couple the sensing unit 180 or the data driver 120 to the data line.

The sensing unit 180 extracts the deterioration information of the organic light emitting diode included in each pixel 140 and supplies the extracted deterioration information to the control block 190. Also, the sensing unit 180 extracts the threshold/mobility information of the driving transistor included in each pixel 140 and supplies the extracted threshold voltage/mobility information to the control block 190. To this end, the sensing unit 180 includes the sensing circuit coupled to each of the data lines D1 to Dm. In other words, the sensing unit 180 may have a sensing circuit per channel (e.g., per data line).

The control block 190 stores the deterioration information and the threshold voltage/mobility information supplied from the sensing unit 180. In one embodiment, the control block 190 stores the deterioration information of the organic light emitting diode and the threshold voltage/mobility information of the driving transistor included in each of the pixels. To this end, the control block 190 in one embodiment includes a memory and a controller for transferring the information stored in the memory to the timing controller 150.

The timing controller 150 controls the data driver 120, the scan driver 110, and the control line driver 160. Also, the timing controller 150 generates second data Data2 by converting bit value of first data Data1 input from the outside, in accordance with the information supplied from the control block 190. In one embodiment, the number of bits in the first data Data1 is i (i is a natural number) and the number of bits in the second data Data2 is j (j is a natural number having a value of i or more). In one embodiment, i=8; in other embodiments, i may be 6, 8 or 10. In one embodiment, j=8 or 10; in other embodiments, j may be 6, 8, 10 or 12.

The second data Data2 generated by the timing controller 150 is supplied to the data driver 120. Then, the data driver 120 uses the second data Data2 to generate the data signal and supplies the generated data signal to the pixels 140.

The power supply line driver 160 supplies voltage of a high-level first power ELVDD or a low-level first power ELVDD to the power supply lines VL1 to VLn. Although the power supply line driver 160 is coupled to the power supply lines VL1 to VLn positioned in parallel with the scan lines S1 to Sn in FIG. 2, the present invention is not limited thereto. For example, the power supply lines VL1 to VLn may be coupled to the power supply line driver 160 and be in parallel with the data lines D1 to Dm.

Figure 3:
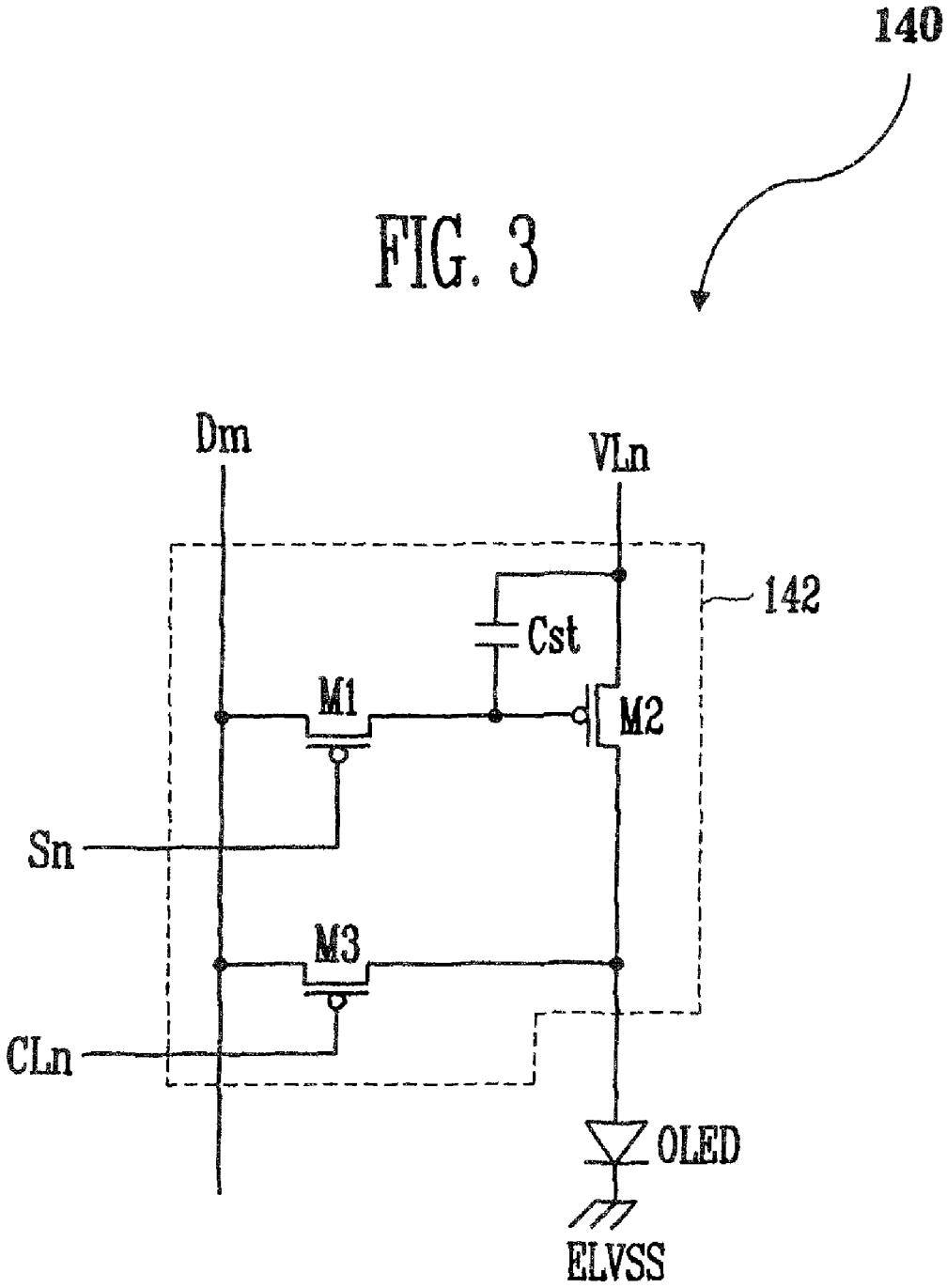
FIG. 3 is a view showing an embodiment of a pixel shown in FIG. 2.

FIG. 3 is a view showing an embodiment of a pixel 140 shown in FIG. 2. For convenience of description, FIG. 3 shows a single pixel coupled to an $m^{th}$ data lines Dm and an $n^{th}$ scan line Sn.

Referring to FIG. 3, the pixel 140 according to one embodiment of the present invention includes an OLED and a pixel circuit 142 for supplying current to the OLED.

The anode electrode of the OLED is coupled to the pixel circuit 142 and the cathode electrode of the OLED is coupled to the second power supply ELVSS. The OLED generates light having luminance corresponding to current supplied by the pixel circuit 142.

The pixel circuit 142 is supplied with the data signal from the data line Dm when the scan signal is supplied to the scan line Sn. Also, the pixel circuit 142 provides at least one of the deterioration information of the organic light emitting diode OLED or the threshold voltage/mobility information of the driving transistor (i.e., the second transistor M2) when the control signal is supplied to the control line CLn. To this end, the pixel circuit 142 includes three transistors M1, M2 and M3 and a storage capacitor Cst.

A gate electrode of the first transistor M1 is coupled to the scan line Sn and a first electrode of the first transistor M11 is coupled to the data line Dm. Further, a second electrode of the first transistor M1 is coupled to a first terminal of the storage capacitor Cst. The first transistor M1 is turned on when the scan signal is supplied to the scan line Sn. Here, the scan signal is supplied in a period (e.g., a first period) where the threshold voltage/mobility information is sensed and in a period (e.g., a third period) where the data signal is supplied to the storage capacitor Cst.

A gate electrode of the second transistor M2 is coupled to the first terminal of the storage capacitor Cst and a first electrode of the second transistor M2 is coupled to the second terminal of the storage capacitor Cst and the power supply line VLn. The second transistor M2 controls the amount of current that flows from the high-level first power supply ELVDD to the second power supply ELVSS via the organic light emitting diode OLED in accordance with the value of the voltage stored in the storage capacitor Cst. The OLED generates light corresponding to the amount of current supplied from the second transistor M2.

A gate electrode of the third transistor M3 is coupled to the control line CLn and a first electrode of the third transistor M3 is coupled to a second electrode of the second transistor M2. Also, a second electrode of the third transistor M3 is coupled to the data line Dm. The third transistor M3 is turned on when the control signal is supplied to the control line CLn (i.e., when a low level control signal is applied at its gate). When the control signal is not supplied, the third transistor M3 is turned off. Here, the control signal is supplied during a period (e.g., a second period) in which the deterioration information of the organic light emitting diode OLED is sensed and a period (e.g., the first period) in which the threshold voltage/mobility information of the second transistor M2 is sensed.

Figure 4:
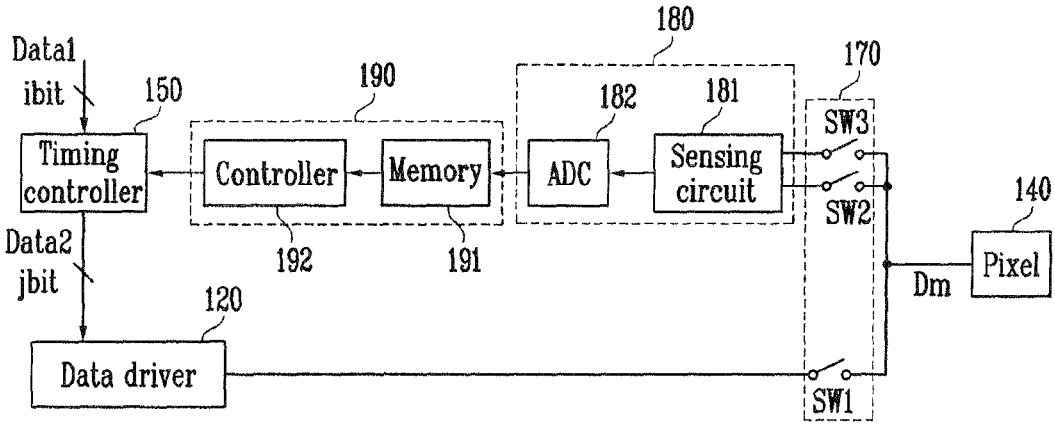
FIG. 4 is a view showing in detail a switching unit, a sensing unit, and a control block shown in FIG. 2.

FIG. 4 further illustrates the switching unit 170, the sensing unit 180, and the control block 190 shown in FIG. 2. For convenience of description, FIG. 4 shows a connection configuration of the switching unit 170, the sensing unit 180, and the control block 190 with the $m^{th}$ data line Dm and one of the pixels 140 coupled to the $m^{th}$ data line Dm.

Referring to FIG. 4, three switching devices SW1, SW2 and SW3 are provided in each channel of the switching unit 170. Further, each channel of the sensing unit 180 includes a sensing circuit 181 and an analog-digital converter (hereinafter, referred to as "ADC") 182. In this and other embodiments, each ADC may be shared by a plurality of channels or a single ADC may be shared by all of the channels. Also, the control block 190 includes a memory 191 and a controller 192. The number of bits of sensed data generated by ADC may be 8 in one embodiment.

Figure 5:
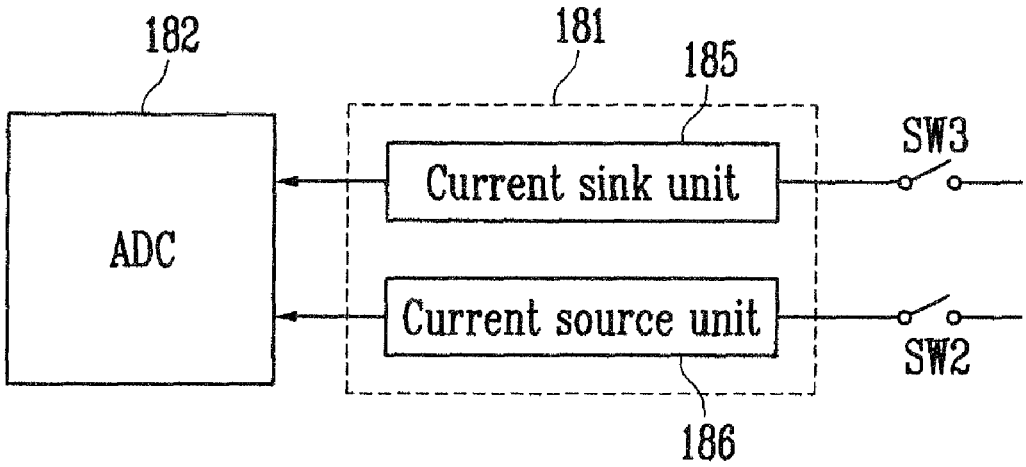
FIG. 5 is a view showing a sensing circuit shown in FIG. 4.

The first switching device SW1 is positioned between the data driver 120 and the data line Dm. The first switching device SW1 is turned on when the data signal is supplied from the data driver 120. In other words, the first switching device SW1 maintains the turn-on state at least during a period (e.g., the third period) in which the data signal is provided to the pixel 140 (or while the organic light emitting display displays an image). The sensing circuit 181 includes a current sink 185 and a current source 186 as shown in FIG. 5.

The current sink 185 sinks a first current from the pixel 140 when the high-level first power supply ELVDD is supplied to the power supply line VLn and supplies a corresponding voltage generated in the data line Dm to the ADC 182 when the first current is sunk. Here, the first current is sunk via the second transistor M2 included in the pixel 140. Therefore, the voltage (i.e., a first voltage) of the data line Dm generated by the current sink 185 has the threshold voltage/mobility information of the second transistor M2. The first voltage may have a value of between 5V and 8V, for example. The current value of the first current may be set variously to apply a reference voltage (e.g., a predetermined voltage) within a defined time (e.g., 4 μs). For example, the first current may be set to the value of a current (e.g., 1 μA) to be flowed to the OLED when the pixel 140 is light-emitted at maximum luminance.

The current source 186 supplies a second current to the pixel 140 when the low-level first power supply ELVDD is supplied to the power supply line VLn and supplies a second voltage generated across the OLED to the ADC 182 when the second current is supplied. The second voltage may be between 8V and 10V, for example. Here, since the second current is supplied via the OLED, the second voltage has the deterioration information of the OLED.

In more detail, as the OLED is deteriorated, the resistance value of the OLED is changed (e.g., increased). Therefore, the voltage value of the second voltage is changed corresponding to the deterioration of the OLED so that the deterioration information of the OLED can be extracted. In the described embodiment, the current value of the second current is experimentally determined to be able to apply a predetermined voltage prior to the deterioration. For example, in one exemplary embodiment, the second current may be set to have the same current value as the first current.

The ADC 182 converts the first voltage supplied from the sensing circuit 181 to a first digital value and converts the second voltage to a second digital value.

The memory 191 of the control block 190 stores the first digital value and the second digital value supplied from the ADC 182. In practice, the memory 191 stores the threshold voltage/mobility information of the second transistor M2 and the deterioration information of the OLED of each of the pixels 140 included in the display unit 130.

The controller 192 transfers the first digital value and the second digital value stored in the memory 191 to the timing controller 150. Here, the controller 192 transfers to the timing controller 150 the first digital value and the second digital value extracted from the pixel 140 that will receive the second data Data2 corresponding to the first data Data1 input to the timing controller 150.

The timing controller 150 is supplied with the first data Data1 from the outside and the first digital value and the second digital value from the controller 192. The timing controller 150 supplied with the first digital value and the second digital value changes the bit value of the first data Data1 to the second data Data2 so that the image with uniform luminance can be displayed. In other words, in one embodiment, the timing controller 150 converts the first data Data1 to the second data Data2 using the first and second digital values such that the first data Data1 having the same value will result in substantially the same luminance in each of the same color pixels 140 regardless of the variation in the threshold voltage/mobility and over time regardless of the OLED deterioration.

For example, in one embodiment, the timing controller 150 decreases the bit value of the first data Data1 as the OLED is deteriorated based on the second digital value to generate the second data Data2. Then, the second data Data2 is generated reflecting the deterioration information of the OLED and thus, the generation of light with low luminance resulting from the OLED deterioration is prevented. Also, the timing controller 150 generates the second data Data2 to compensate for the threshold voltage/mobility of the second transistor M2 based on the first digital value so that the image with substantially uniform luminance can be displayed regardless of the threshold voltage/mobility of the second transistor M2.

The data driver 120 generates the data signal using the second data Data2 and supplies the generated data signal to the pixel 140.

Figure 6:
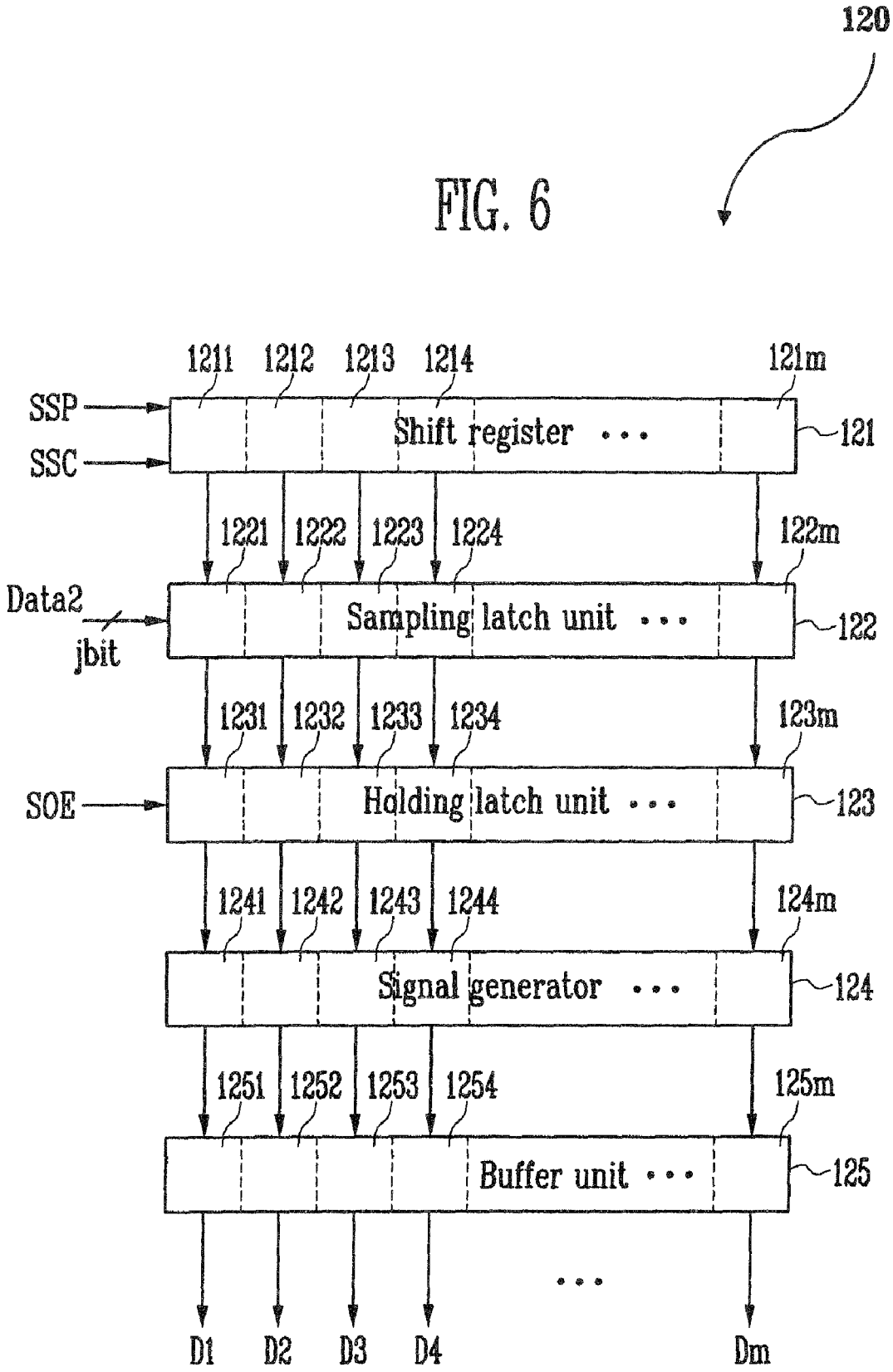
FIG. 6 is a view showing a data driver shown in FIG. 2.

FIG. 6 is a view showing the data driver 120 according to one exemplary embodiment.

Referring to FIG. 6, the data driver 120 includes a shift register unit 121, a sampling latch unit 122, a holding latch unit 123, a signal generator 124, and a buffer unit 125.

The shift register unit 121 receives a source start pulse SSP and a source shift clock SSC from the timing controller 150. The shift register unit 121 then shifts the source start pulse SSP per one period of the source shift clock SSC to sequentially generate m sampling signals. To this end, the shift register unit 121 includes m shift registers 1211 to 121*m*.

The sampling latch unit 122 sequentially stores second data Data2 in response to the sampling signals sequentially supplied from the shift register unit 121. To this end, the sampling latch unit 122 includes m sampling latches 1221 to 121*m* in order to store m second data Data2.

The holding latch unit 123 receives a source output enable signal SOE from the timing controller 150. The holding latch unit 123 then receives and stores second data Data2 from the sampling latch unit 122. Further, the holding latch unit 123 supplies the second data Data2 stored therein to the signal generator 124. To this end, the holding latch unit 123 includes m holding latches 1231 to 123*m*.

The signal generator 124 receives the second data Data2 from the holding latch unit 123 and generates m data signals corresponding to the received second data Data2. To this end, the signal generator 124 includes m digital-analog converters (hereinafter, referred to as "DAC") 1241 to 124*m*. That is, the signal generator 124 generates the m data signals using the DACs 1241 to 124*m* each positioned at a corresponding channel and supplies the generated data signals to the buffer unit 125.

The buffer unit 125 supplies the m data signals supplied from the signal generator 124 to each of m data lines D1 to Dm. To this end, the buffer unit 125 includes m buffers 1251 to 125*m*.

Figure 7A:
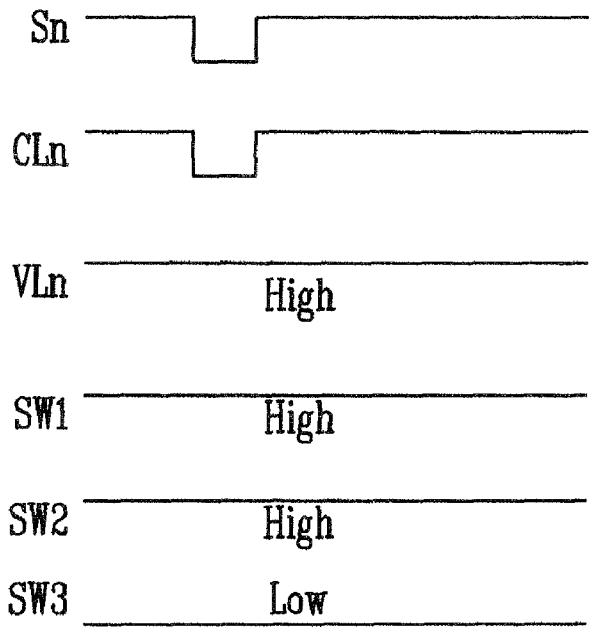
FIGS. 7A, 7B and 7C are views showing a driving waveform supplied to a pixel and a switching unit in an exemplary embodiment according to the present invention.
Figure 7B:
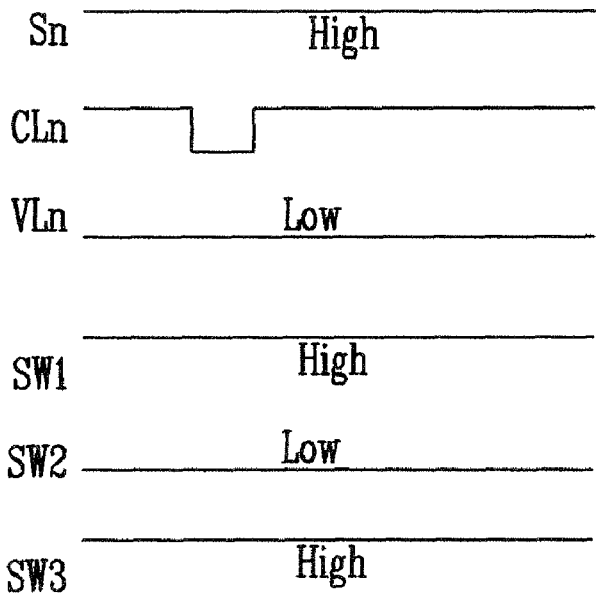
Figure 7C:
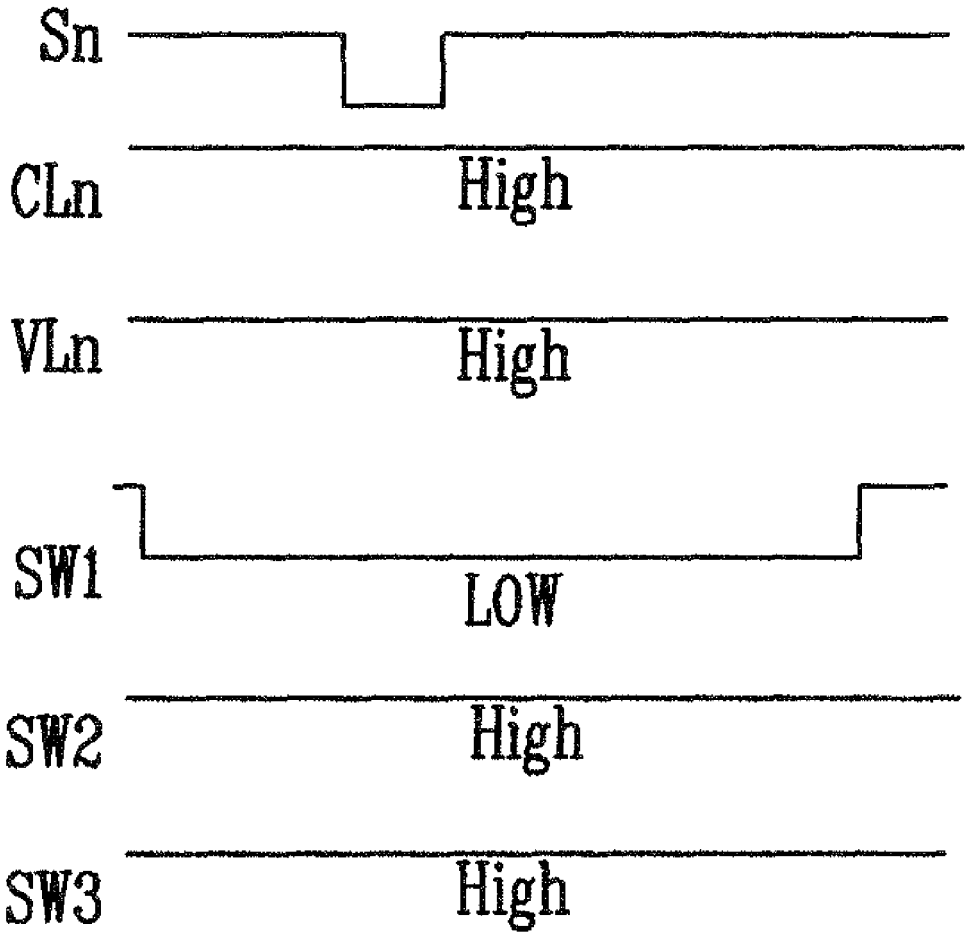

FIGS. 7A to 7C are views showing driving waveforms supplied to a pixel and a switching unit.

FIG. 7A shows a waveform diagram during the first period for sensing threshold voltage/mobility of the second transistor M2 included in the pixels 140. The scan driver 110 sequentially supplies the scan signals to the scan line S1 to Sn during a sensing period of the threshold voltage/mobility of the second transistor M2 included in the pixels 140. For example, the scan signals may have a high voltage of +14V and a low voltage of −2V in one embodiment. Also, when the scan signal is supplied to $k^{th}$ (k is a natural number) scan line Sk, the scan driver 110 supplies a control signal to a $k^{th}$ control line CLk. For example, the control signals may have a high voltage of +14V and a low voltage of −2V in one embodiment.

The power supply line driver 160 supplies the voltage of the high-level first power supply ELVDD to the power supply lines VL1 to VL. Here, the voltage value (e.g., 12V) of the high-level first power supply ELVDD is set to a value higher than the voltage value (e.g., 0V) of the second power supply ELVSS so that current may flow in the second transistor M2. Meanwhile, the third switching device SW3 maintains a turn-on state during the sensing period of the threshold voltage/mobility of the second transistor M2.

Figure 8A:
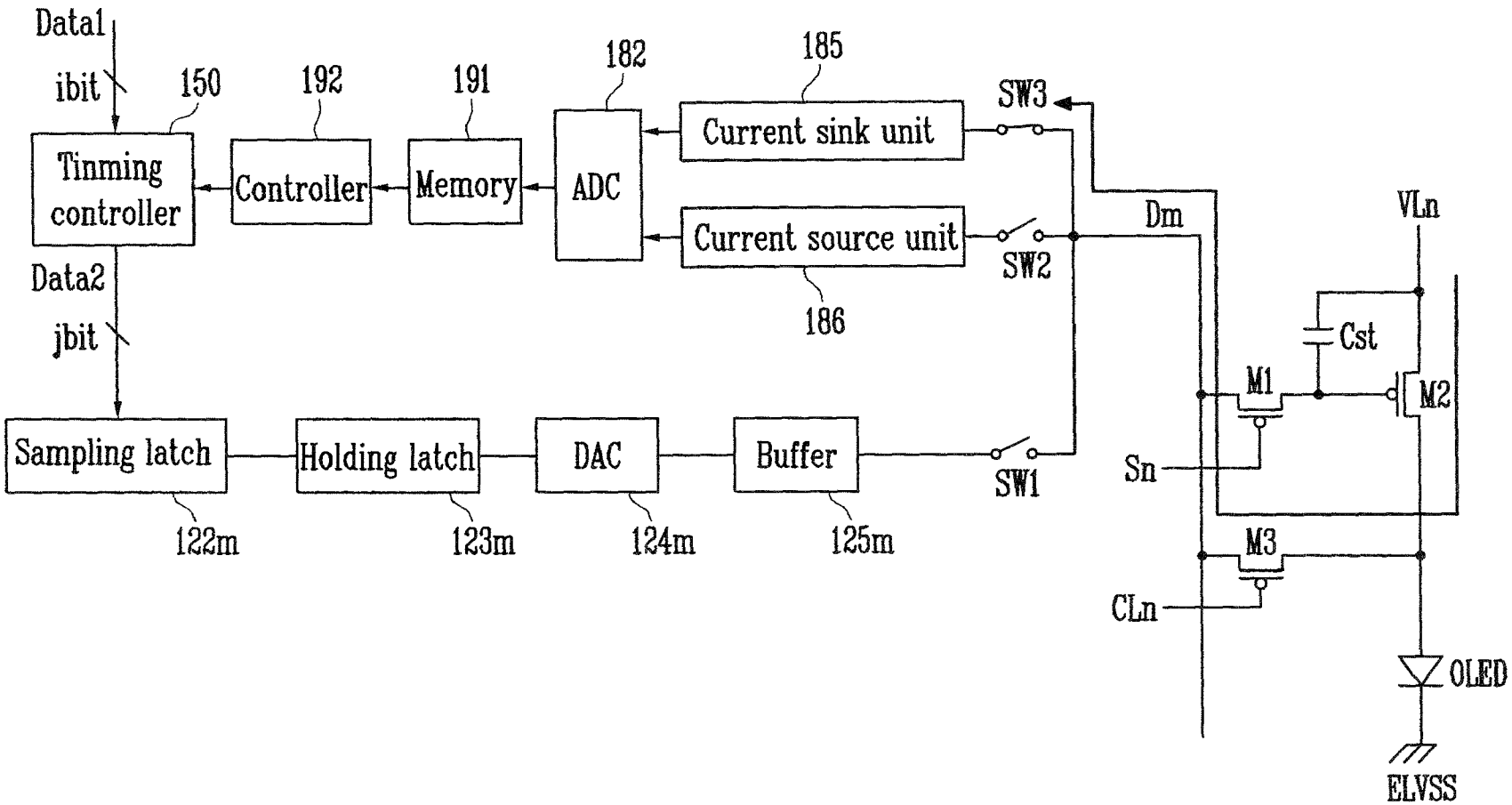
FIGS. 8A, 8B and 8C are views that show a data driver, a timing controller, a control block, a sensing unit, a switching unit, and a pixel, and a current flow corresponding to the waveforms of FIGS. 7A, 7B and 7C, respectively.

An operation process will be described in detail with reference to FIGS. 7A and 8A. First, when the scan signal is supplied to the scan line Sn, the first transistor M1 is turned on. When the first transistor M1 is turned on, the gate electrode of the second transistor M2 and the data line Dm are electrically coupled. And, the third transistor M3 is turned on by the control signal supplied to the control line CLn in synchronization with the scan signal.

At this time, the current sink 185 sinks the first current (shown in FIG. 8A) from the first power supply ELVDD via the second transistor M2, the third transistor M3, and the third switching device SW3. When the first current is sunk in the first sink unit 185, the first voltage is applied to the current sink 185. Here, since the first current is sunk via the second transistor M2, information on the threshold voltage/mobility of the second transistor M2 is included in the first voltage. For example, in one embodiment, the voltage applied to the gate electrode of the second transistor M2 is used as the first voltage.

The first voltage applied to the current sink 185 is converted to a first digital value in the ADC 182 to be supplied to the memory 191. Accordingly, the first digital value is stored in the memory 191. Through such a process, the first digital value including the information on the threshold voltage/mobility of the second transistor M2 included in each of the pixels 140 is stored in the memory 191.

In the described embodiment of the present invention, a process for sensing the threshold voltage/mobility of the second transistor M2 may be performed more than once before the organic light emitting display is used. For example, before the organic light emitting display is shipped, it is possible to sense the threshold voltage/mobility of the second transistor M2 to store it in the memory 191. Also, the process for sensing the threshold voltage/mobility of the second transistor M2 may be performed at the time of user's designation.

FIG. 7B shows a waveform diagram during the second period for sensing deterioration information of the organic light emitting diode included in each of the pixels.

The scan driver 110 sequentially supplies the control signals to the control lines CL1 to CLn during a sensing period of the deterioration information of the organic light emitting diode OLED included in each of the pixels 140. The second switching device SW2 maintains a turn-on state during the sensing period of the deterioration information of the organic light emitting diode OLED. Also, the power supply line driver 160 supplies the low-level first power ELVDD to the power supply lines VL1 to VLn during the sensing period of the deterioration information of the organic light emitting diode OLED. Here, the low-level first power ELVDD is set to a voltage capable of turning off the second transistor M2. For example, the low level first power ELVDD may be set to the same voltage as the second power ELVSS.

Figure 8B:
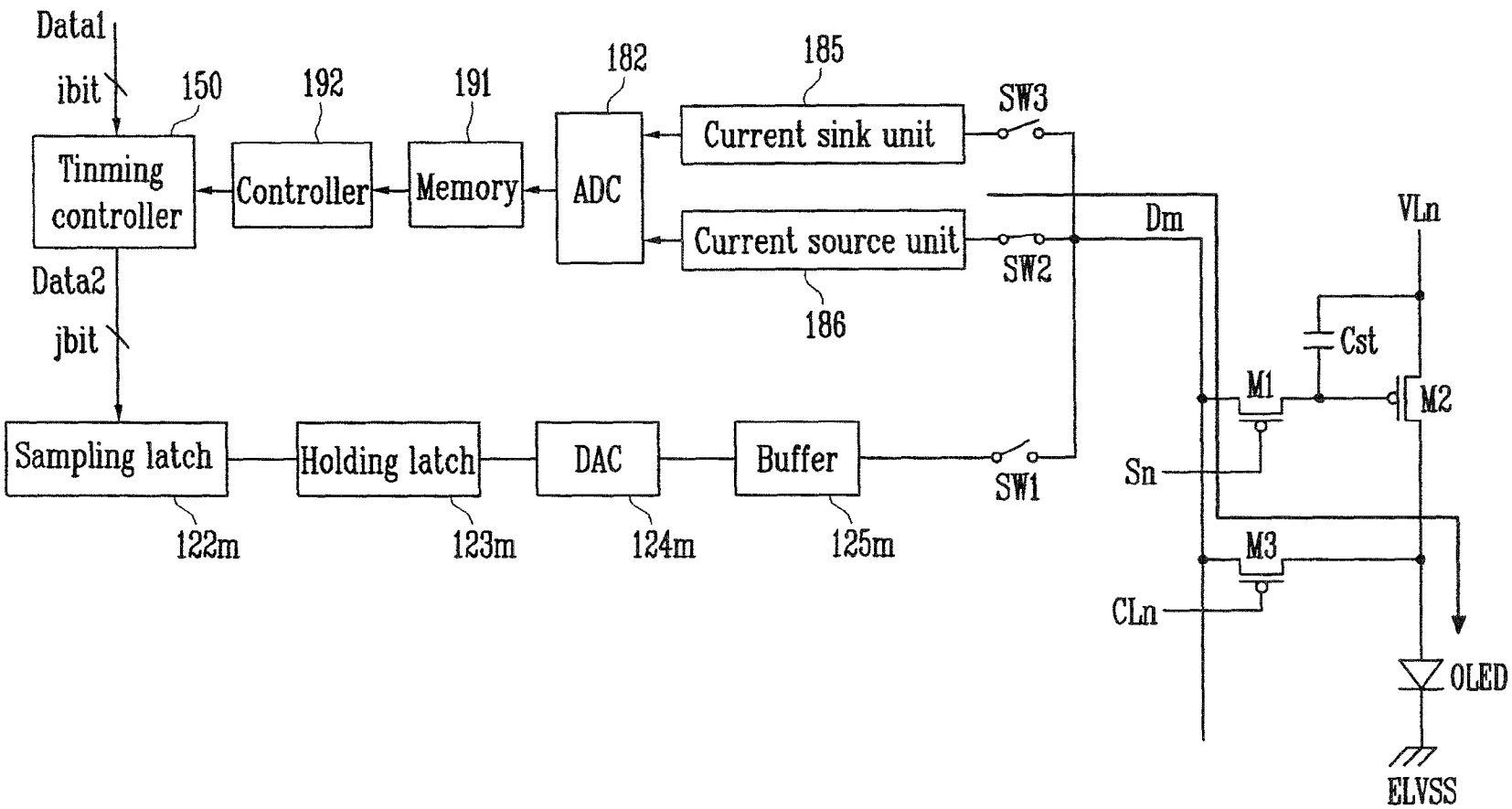

An operation process will be described in detail with reference to FIGS. 7B and 8B. First, when the control signal is supplied to the control line CLn, the third transistor M3 is turned on. When the third transistor M3 is turned on, the organic light emitting diode OLED and the data line Dm are electrically coupled to each other.

In this case, the second current supplied by the current source 186 is supplied to the organic light emitting diode OLED via the second switching device SW2 and the third transistor M3. At this time, when the second current is supplied, the current source 186 senses the second voltage applied to the organic light emitting diode OLED and supplies the sensed second voltage to the ADC 182.

The ADC 182 converts the second voltage supplied from the current source 186 to a second digital value to supply it to the memory 191. Accordingly, the second digital value is stored in the memory 191. Through such a process, the second digital value including deterioration information of the organic light emitting diode OLED included in each of the pixels 140 is stored in the memory 191.

In the described embodiment of the present invention, the process for sensing the organic light emitting diode OLED may be performed at a time predefined by a designer. For example, the deterioration information of the organic light emitting diode OLED may be sensed whenever power is supplied to the organic light emitting display.

FIG. 7C shows a waveform diagram for the third period for performing a normal display operation.

During the normal display operation period, the scan driver 110 sequentially supplies the scan signals to the scan lines S1 to Sn, and does not supply the control signals to the control lines CL1 to CLn. During the normal display operation period, the power line driver 160 supplies the high-level first power ELVDD to the power supply lines VL1 to VLn. Further, during the normal display operation period, the first switching device SW1 maintains the turn-on state.

Figure 8C:
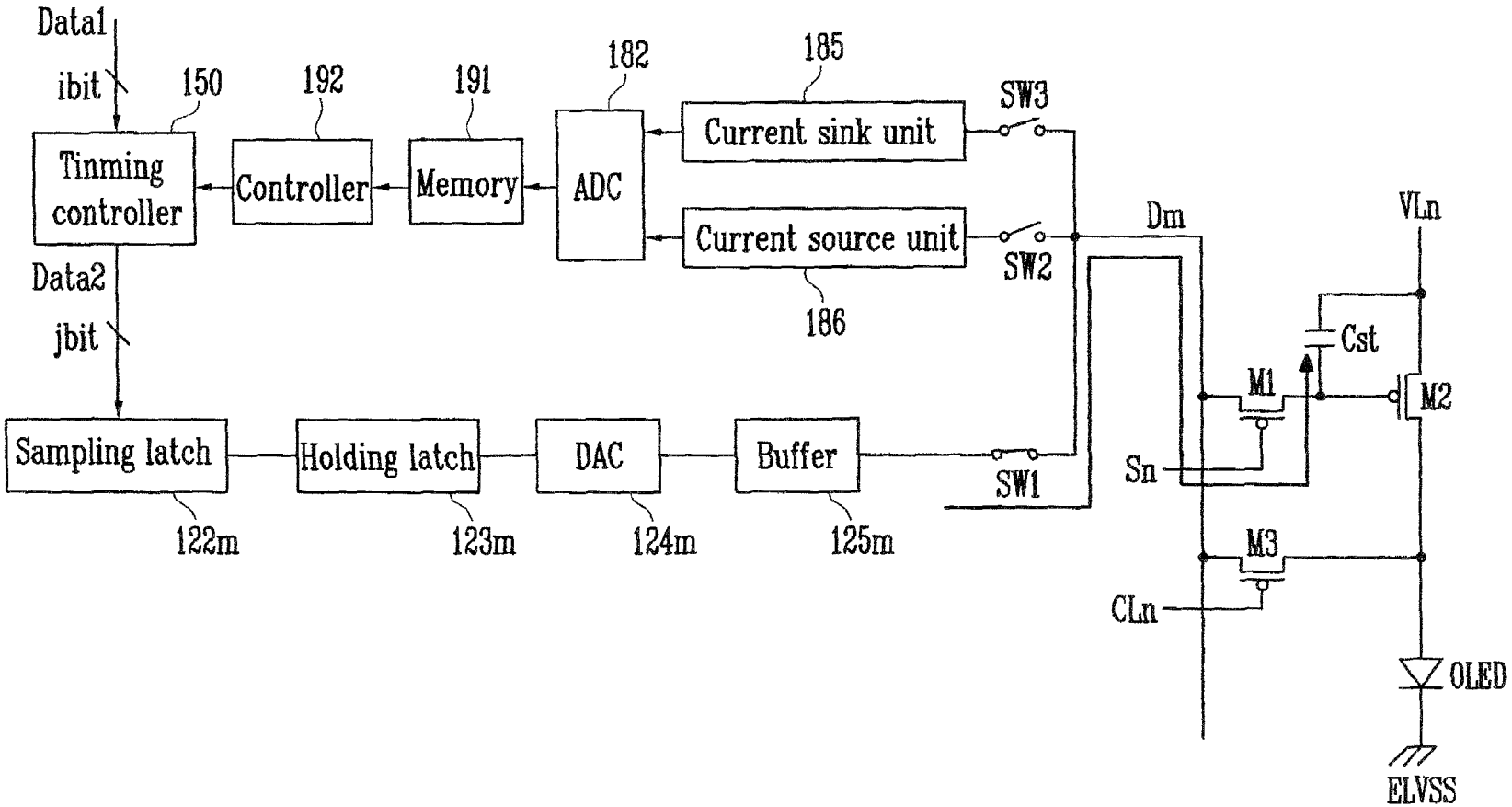

An operation process will be described in detail with reference to FIGS. 7C and 8C. First, the first data Data1 to be supplied to the pixel 140 coupled to the data line Dm and the scan line Sn is supplied to the timing controller 150. At this time, the controller 192 supplies the first digital value and the second digital value extracted from the pixel 140 coupled to the data line Dm and the scan line Sn to the timing controller 150.

After receiving the first and second digital values, the timing controller 150 modifies a bit value of the first data Data1 to generate the second data Data2. Here, the second data Data2 is set so that the deterioration of the organic light emitting diode OLED and the threshold voltage/mobility of the second transistor M2 may be compensated for.

For example, when the first data of "00001110" is input, the timing controller 150 can generate the second data Data2 of "000011110" so that the deterioration of the organic light emitting diode OLED may be compensated for. In this case, since the data signal for displaying the image of a high luminance is generated corresponding to the second data Data2, the deterioration of the organic light emitting diode OLED may be compensated for. Likewise, the timing controller 150 controls the bit value of the second data Data2 so that the deviation in the threshold voltage/mobility of the second transistor may be compensated for.

The second data Data2 generated by the timing controller 150 is supplied to the DAC 124*m* via the sampling latch 122*m* and the hold latch 123*m*. In this case, the DAC 124*m* generates the data signal using the second data Data2 and supplies the generated data signal to the data line Dm via the buffer 125*m*.

Here, since the scan signal is supplied to the scan line Sn so that the first transistor M1 is turned on, the data signal supplied to the data line Dm is supplied to the gate electrode of the second transistor M2. At this time, the storage capacitor Cst is charged with the voltage corresponding to the data signal.

Thereafter, the supply of the scan signal is stopped so that the first transistor M1 is turned off. At this time, the second transistor M2 supplies the current corresponding to the voltage charged in the storage capacitor Cst to the organic light emitting diode OLED. In this case, the organic light emitting diode OLED generates light with a luminance corresponding to the amount of current supplied thereto.

Here, the current supplied to the organic light emitting diode OLED is set so that the deterioration of the organic light emitting diode OLED and the threshold voltage/mobility of the second transistor M2 may be compensated for. Therefore, it is possible to uniformly display the image with a desired luminance. In other words, in one embodiment, the same color OLED would generate substantially the same luminance corresponding to the same data Data1 regardless of the threshold voltage/mobility of the second transistor M2 and the deterioration status of the OLED.

While the present invention has been described in connection with certain exemplary embodiments, it is to be understood that the present invention is not limited to the disclosed embodiments, but, on the contrary, is intended to cover various modification and equivalent arrangements included within the spirit and scope of the appended claims, and equivalents thereof.

What is claimed is:

1. An organic light emitting display comprising:

a plurality of scan lines for applying scan signals;

a plurality of control lines for applying control signals;

a plurality of data lines for applying data signals, the data lines crossing the scan lines and the control lines;

a plurality of pixels for displaying an image, the pixels coupled to the scan lines, the control lines and the data lines;

a plurality of power supply lines coupled to the pixels;

a data driver for supplying the data signals of the image to the plurality of data lines;

a power supply driver for swinging a voltage at the power supply lines between a first level and a second level;

a sensing unit comprising a current sink configured to sink a first current from the pixels and a current source configured to supply a second current to the pixels, the current source being separate from the current sink and the power supply driver; and a switching unit for selectively electrically connecting the plurality of pixels to the data driver, the current source and the current sink to allow a current to flow between the pixels and the connected one of the data driver, the current source, and the current sink, wherein the voltage applied to the power supply lines while the first current flows has a level higher than that of a voltage applied to the power supply lines while the second current flows.

2. The organic light emitting display of claim 1, wherein each of the pixels comprises:

a driving transistor and an organic light emitting diode coupled in series between a corresponding one of the power supply lines and a power source, the organic light emitting diode having an anode coupled to the driving transistor and a cathode coupled to the second power source;

a data switch between a corresponding one of the data lines and a control electrode of the driving transistor, the data switch having a control electrode coupled to a corresponding one of the scan lines;

a capacitor coupled between a first power source and the control electrode of the driving transistor for storing a corresponding one of the data signals; and a control switch between the corresponding one of the data lines and the anode of the organic light emitting diode, the control switch having a control electrode coupled to a corresponding one of the control lines.

3. The organic light emitting display of claim 2, wherein the switching unit comprises:

a first switch between the corresponding one of the data lines and the data driver, the first switch being adapted to turn on when the data driver supplies the corresponding one of the data signals to the corresponding one of the data lines;

a second switch between the corresponding one of the data lines and the current source, the second switch being adapted to turn on when the current source supplies the first current to the corresponding one of the data lines; and a third switch between the corresponding one of the data lines and the current sink, the third switch being adapted to turn on when the current sink receives the second current from the corresponding one of the data lines.

4. The organic light emitting display of claim 1, wherein the current sink is adapted to detect a first voltage corresponding to the first current, and the current source is adapted to detect a second voltage corresponding to the second current.

5. The organic light emitting display of claim 4, further comprising a memory for storing the first voltage and the second voltage.

6. The organic light emitting display of claim 4, further comprising a timing controller adapted to receive external data signals, wherein the timing controller is configured to convert the external data signals to the data signals in accordance with the first voltage and the second voltage.

7. The organic light emitting display of claim 4, wherein the first voltage corresponds to threshold voltage/mobility information of a driving transistor.

8. The organic light emitting display of claim 4, wherein the second voltage corresponds to deterioration information of the organic light emitting diode.

9. The organic light emitting display of claim 4, wherein the sensing unit further comprises an analog-to-digital converter for converting the first voltage and the second voltage to digital data prior to storing them in a memory.

10. A method of adjusting luminance of an image displayed on an organic light emitting display comprising a plurality of pixels coupled to a plurality of data lines, each of the pixels comprising a driving transistor and an organic light emitting diode, the method comprising:

sensing a first sensed voltage while a first current flows through the driving transistor of a pixel among the plurality of pixels to a current sink via a corresponding one of the data lines while a first supply voltage is being supplied to a corresponding one of the pixels;

sensing a second sensed voltage while a second current flows from a current source through the organic light emitting diode of the pixel via the corresponding one of the data lines while a second supply voltage that is lower than the first supply voltage is being supplied to the corresponding one of the pixels; and converting external data to a data signal to be applied to the pixel in accordance with the first sensed voltage and the second sensed voltage.

11. The method according to claim 10, further comprising converting the first sensed voltage and the second sensed voltage to digital data and storing the digital data in a memory.

12. The method according to claim 10, wherein the organic light emitting display further comprises a switching unit coupled to the data lines, the switching unit comprising a plurality of switches for selectively electrically coupling the data lines to at least one of a sensing unit for sensing the first and second sensed voltages or a data driver for supplying the data signal to the pixel.

13. An organic light emitting display comprising:

a plurality of pixels coupled to a plurality of data lines, each of the pixels comprising a driving transistor and an organic light emitting diode;

a current sink for sensing a first voltage corresponding to a first current that flows through the driving transistor of a pixel among the plurality of pixels to the current sink via a corresponding one of the data lines;

a current source for sensing a second voltage corresponding to a second current that flows from the current source through the organic light emitting diode of the pixel via the corresponding one of the data lines;

a timing controller for adjusting a data signal to be applied to the pixel in accordance with the first voltage and the second voltage; and a power supply line driver for supplying power to the pixels, wherein the power supplied while the first voltage is being sensed has a higher voltage than that of the power supplied while the second voltage is being sensed.

14. The organic light emitting display of claim 13, further comprising a data driver for supplying the adjusted data signal to a data line corresponding to the pixel among the plurality of data lines.

* * * * *

UNITED STATES PATENT AND TRADEMARK OFFICE

CERTIFICATE OF CORRECTION

PATENT NO. : 8,405,582 B2
APPLICATION NO. : 12/419875
DATED : March 26, 2013
INVENTOR(S) : Yang-Wan Kim et al.

It is certified that error appears in the above-identified patent and that said Letters Patent is hereby corrected as shown below:

In the Claims

Column 11, Claim 2, line 59 Delete "the"

Insert -- a --

Signed and Sealed this
Fifteenth Day of July, 2014

Michelle K. Lee

Michelle K. Lee
*Deputy Director of the United States Patent and Trademark Office*